US009783863B2

(12) United States Patent
Poloni et al.

(10) Patent No.: US 9,783,863 B2
(45) Date of Patent: Oct. 10, 2017

(54) SUSPENSION DEVICE FOR TILTING OXYGEN CONVERTERS AND CONVERTER PROVIDED WITH SAID SUSPENSION DEVICE

(71) Applicant: Danieli & C. Officine Meccaniche S.P.A., Buttrio (IT)

(72) Inventors: Alfredo Poloni, Fogliano Redipuglia (IT); Matteo Nobile, Ruda (IT)

(73) Assignee: Danieli & C. Officine Meccaniche S.P.A., Buttrio (IT)

( * ) Notice: Subject to any disclaimer, the term of this patent is extended or adjusted under 35 U.S.C. 154(b) by 236 days.

(21) Appl. No.: 14/402,293

(22) PCT Filed: May 20, 2013

(86) PCT No.: PCT/IB2013/054132

§ 371 (c)(1),
(2) Date: Nov. 19, 2014

(87) PCT Pub. No.: WO2013/175384

PCT Pub. Date: Nov. 28, 2013

(65) Prior Publication Data

US 2015/0152514 A1 Jun. 4, 2015

(30) Foreign Application Priority Data

May 21, 2012 (IT) ..... MI2012A0871

(51) Int. Cl.
*C21C 5/50* (2006.01)
*F27B 3/06* (2006.01)
*C21C 5/46* (2006.01)

(52) U.S. Cl.
CPC ..... *C21C 5/50* (2013.01); *C21C 5/4633* (2013.01); *F27B 3/065* (2013.01)

(58) Field of Classification Search
CPC ..... C21C 5/4633; C21C 5/50; F27B 3/065
(Continued)

(56) References Cited

U.S. PATENT DOCUMENTS 3,337,205 A * 8/1967 Puxkandl ..... C21C 5/4633 266/246
3,561,744 A * 2/1971 Altman ..... C21C 5/4633 266/246

(Continued)

FOREIGN PATENT DOCUMENTS

CN 101638710 2/2010
CN 201817511 5/2011

(Continued)

*Primary Examiner* — Scott Kastler
*Assistant Examiner* — Michael Aboagye
(74) *Attorney, Agent, or Firm* — Stetina Brunda Garred & Brucker

(57) ABSTRACT

A suspension device (8) for a converter, comprising a central structure (8'), adapted to be fixed to a container (2) of the converter (1), a first lateral structure (29), arranged at a first side of the central structure and adapted to be fixed to a first surface (10, 11) of a supporting ring (3) of the container, a second lateral structure (28), arranged at a second side of said central structure and adapted to be fixed to the surface (10, 11), wherein two wedge-shaped elements (15, 15') are provided, each element being provided between the central structure and a respective lateral structure and configured so as to slide on sliding surfaces (23, 24, 24') connected respectively to the central structure and to the respective lateral structure, wherein each wedge-shaped element is crossed by at least one tie-rod (16, 16') connected thereto, and wherein elastic means (17) are provided, which are associated to or intrinsic with said one tie-rod and configured to maintain a wedging of the wedge-shaped element.

10 Claims, 13 Drawing Sheets

(58) Field of Classification Search
USPC ..... 266/243–248
See application file for complete search history.

(56) References Cited

U.S. PATENT DOCUMENTS

| | | | | |
|---|---|---|---|---|
| 3,653,648 | A | 4/1972 | Mevissen et al. | |
| 3,717,333 | A * | 2/1973 | Valdenazzi | C21C 5/4633 266/246 |
| 4,275,871 | A * | 6/1981 | Nagati | C21C 5/4633 266/243 |
| 8,945,465 | B2 * | 2/2015 | Reeves | B22D 41/00 266/275 |
| 9,506,124 | B2 * | 11/2016 | Poloni | C21C 5/4633 |

FOREIGN PATENT DOCUMENTS

| | | |
|---|---|---|
| DE | 2340618 | 2/1975 |
| WO | WO95025818 | 9/1995 |

* cited by examiner

SUSPENSION DEVICE FOR TILTING OXYGEN CONVERTERS AND CONVERTER PROVIDED WITH SAID SUSPENSION DEVICE

CROSS REFERENCE TO RELATED APPLICATIONS

The present application claims priority to PCT International Application No. PCT/IB2013/054132 filed on May 20, 2013, which application claims priority to Italian Patent Application No. M12012A000871 filed May 21, 2012, the entirety of the disclosures of which are expressly incorporated herein by reference.

STATEMENT RE: FEDERALLY SPONSORED RESEARCH/DEVELOPMENT

Not Applicable.

FIELD OF THE INVENTION

The present invention relates to a suspension device for tilting oxygen converter containers and to a converter provided with at least one pair of such suspension devices connecting the container to a supporting ring.

STATE OF THE ART

The main object of an oxygen converter is to convert the cast iron produced in the blast furnace into raw liquid steel, which may be subsequently refined in the secondary steel production department.

The main functions of the oxygen converter, also known as B.O.F. (Basic Oxygen Furnace), are to decarburize and remove phosphorous from the cast iron and to optimize the temperature of the steel so that further treatments may be carried out before casting with minimum heating and cooling of the steel.

The exothermal oxidation reactions which are generated in the converter produce a great deal of thermal energy, more than that needed to reach the established temperature of the steel. This extra heat is used to melt ferrous material scrap and/or additions. The B.O.F. is substantially a furnace and thus subject to thermal expansion.

The converter consists of a container, defining the reactor and having a substantially cylindrical shape, supported by a trunnion ring, surrounding the container and appropriately distanced therefrom, provided with two diametrical opposite supporting pins or trunnions, all supported by two supports anchored to the ground. The rotating control of the container is fitted onto one of the trunnions.

An example of oxygen converter of the prior art is described in WO9525818. The container is supported by means of an outer supporting ring and a plurality of suspension devices, each having a first structure welded to the container and a second T-shaped structure bolted onto the supporting ring. A shim, which allows to adjust the two structures during the step of assembling, may be provided at the interface between the structure welded to the container and the T-shaped structure fixed to the ring.

Movements are created on the horizontal plane between said two structures of the suspension devices, considering the converter in the vertical position thereof with the mouth facing upwards, because of the thermal expansions of the container and the supporting ring (due to the high temperatures which are generated inside the oven), and consequently of the respective structures connected thereto, said movements causing the creation of clearances or, in the case of compression between the two structures, overload of the parts due to excessive pressure.

If clearance is created between the two structures, the container becomes mobile with respect to the supporting ring thus becoming unstable (in particular, during the rotation thereof), the structures of the suspension devices resting one upon the other on either side of the converter, giving rise to pulsing loads on the entire structure and to vibrations caused by shaking which occurs as a result of reactions happening inside.

Instead, deformations in the shims or in the container which become permanent during cooling may occur in case of compression between the two structures.

A further converter, disclosed in U.S. Pat. No. 3,653,648, is supported by an outer supporting ring and a plurality of suspension devices, each having a first anchor fixed to the container and a second anchor fixed directly to the supporting ring. A wedge-shaped shim, fixed in turn by means of screws during the step of assembling of the converter, allowing an adjustment of the suspension device exclusively during the step of assembling of the converter, is provided at the interface between the two anchors. Also in this case, pulsing loads occur in the entire structure, together with vibrations caused by shaking occurring as a result of the reactions happening inside, deformations of the shims or of the container which become permanent later on upon cooling.

The centering between container and supporting ring is also important to suitably allow deformations or thermal expansions of the container caused by the high temperatures reached during the conversion process.

It is thus felt the need to make a suspension device for tilting converter containers and a respective tilting converter which allow to overcome the aforesaid drawbacks.

SUMMARY OF THE INVENTION

It is a primary scope of the present invention to make a suspension and centering device for a tilting converter container, connecting said container to a supporting ring thereof, which allows both to compensate for thermal expansions, avoiding the creation of clearance between container, supporting ring and respective sliding shoes, and to avoid overloads in the interface zone between the part of the device fixed to the container and the parts of the device fixed to the supporting ring.

Another object of the invention is to make a tilting converter in which the container suspension system, comprising horizontal and vertical suspension devices, is capable of maintaining an accurate centering without clearance between container and supporting ring in all steps of operation of the converter.

A further object of the invention is to make a converter in which the suspension system can absorb the vibrations induced by the melting process.

The present invention thus suggests to reach the objects above by making a suspension device for a tilting converter which, according to claim 1, comprises a central structure, adapted to be fixed to a container of the converter; a first lateral structure, arranged at a first side of said central structure and adapted to be fixed to a first surface of a supporting ring of the container; a second lateral structure, arranged at a second side of said central structure, opposite said first side, and adapted to be fixed to said first surface of the supporting ring; wherein two wedge-shaped elements are provided, each wedge-shaped element being arranged between the central structure and a respective lateral structure and configured so as to slide on two sliding surfaces of the central structure and of the respective lateral structure, respectively; wherein each wedge-shaped element is crossed by at least one tie-rod connected thereto; and wherein elastic means associated to said at least one tie-rod or wherein said at least one tie-rod with its intrinsic elasticity are configured to produce a constant wedging of the wedge-shaped element whereby, when the suspension device is mounted to the container and to the supporting ring, an automatic adjustment of the suspension device occurs as the expansions produced between central structure and lateral structures vary during the operation of the converter.

Another aspect of the invention relates to a tilting converter which, according to claim 11, comprises a container defining a first axis X; a supporting ring, coaxial to the container and spaced apart from said container, provided with two diametrically opposite supporting pins, defining a second axis Y orthogonal to the first axis X, adapted to allow the converter to rotate about said second axis; suspension devices, connecting said container to said supporting ring; wherein there are provided first suspension devices, comprising groups of elastic bars arranged parallel to the first axis X, said groups of bars being arranged substantially equally spaced apart from one another along said supporting ring; wherein there is provided at least one pair of second suspension devices according to claim 1, in which the central structure is fixed to the container, the first lateral structure is fixed to a first surface of the supporting ring, and the second lateral structure is fixed to said first surface, said second suspension devices being each arranged at a respective trunnion and transversally to a first plane X-Y.

The suspension device, subject of the present invention, was designed to provide horizontal support to the converter, i.e. to support the loads when the converter assumes tapping position (FIG. 9). Such a horizontal suspension device has an innovative structure which compensates for expansions by virtue of the presence of wedge-shaped elements which are maintained always compressed by at least one respective tie-rod and springs, so that these wedge-shaped elements, being able to slide on sliding surfaces or guide blocks associated respectively to the part of the device fixed to the container and to parts fixed to the supporting ring, advance towards the supporting ring to occupy possible clearances or back, leaving space between the part fixed to the ring and the part fixed to the container, in case of excessive compression loads between said parts of the suspension device.

In this manner, when the suspension device of the invention is fitted on the container and on the supporting ring, the suspension device is automatically adjusted as the expansions which are produced between central structure and lateral structures of the device during operation of the converter, i.e. between converter and supporting ring, vary.

In a first advantageous embodiment of the suspension device of the invention, the wedge-shaped elements are maintained wedged, i.e. maintained compressed, by means of at least one respective tie-rod which crosses the entire supporting ring. Considering the vertical configuration of the converter, i.e. with the mouth of the converter facing upwards, a first end of the tie-rod is restrained to the wedge-shaped element provided either underneath (FIG. 1) or above (FIGS. 3 and 4) the supporting ring, while a second end of the tie-rod, provided with a housing containing the elastic means, is arranged either above (FIG. 1) or underneath (FIGS. 3 and 4) the supporting ring. The device is configured so that the elastic means, appropriately preloaded during the step of assembling, work on the second end of the tie-rod causing, as a consequence, a sliding of the respective wedge-shaped element if clearance is created between container and supporting ring.

In a second advantageous embodiment of the suspension device of the invention, each tie-rod is integrally fixed, at a first end thereof, to the corresponding lateral structure of the suspension device, and the elastic means are restrained to a second end of the tie-rod and positioned in a housing provided in a recess of the wedge-shaped element whereby the elastic means act directly on the wedge-shaped element causing it to slide and to be wedged in if clearance is created between container and supporting ring.

Preferably, two wedge-shaped elements are provided for each suspension device of the invention, one for each interface between the structure fixed to the container and the structures fixed to the ring, each wedge-shaped element being crossed by two tie-rods.

A preferred, but not exclusive, embodiment of a tilting converter comprises:

- at least two suspension devices, according to the present invention, for the horizontal supporting of the converter, each arranged near a respective supporting pin, either above or underneath the supporting ring;
- and four groups of elastic bars provided in a fixed-end configuration to vertically support the converter, i.e. when the converter has the container with mouth facing either upwards or downwards.

A variant of the converter may be provided, comprising:

- four suspension devices, according to the present invention, for horizontal supporting of the converter; a first pair of such devices being arranged above the supporting ring and a second pair being arranged below said ring;
- and four groups of elastic bars provided in a fixed-end configuration to vertically support the converter.

The groups of elastic bars contain a variable number of bars from two to six, preferably four.

The structure of the converter obtained as a whole is compact, solid and adaptable to the working conditions of the furnace or converter.

The elastic means are, for example, Belleville washers, which maintain the mechanical tension constant also in the presence of thermal stress and allow to relieve a high force even in very small spaces. Volute springs, helical springs with round or square section wire or any other type of springs suited to the purpose may alternatively be used.

In all the embodiments of the invention, the elastic means may be constituted by the same tie-rods which cross the wedge-shaped elements, alternatively to springs. In these cases, it is the elasticity of the tie-rod itself which maintains the mechanical tension constant also in the presence of thermal stress and allows to relieve a high force even in very small spaces. The elasticity of the tie-rods thus maintains the wedging of the wedge-shaped elements, i.e. produces a constant wedging of said wedge-shaped elements to maintain them compressed.

In particular, the suspension device of the converter object of the present invention has the following advantages:

- it allows to easily absorb the thermal expansions of the container;
- it effectively absorbs the vibrations which are generated during blowing of oxygen into the container, as a virtue of a constant compensation of the clearances;
- it effectively absorbs the forces generated by the inertia of the container at the beginning and end of its rotation;

it maintains the container centered with respect to the supporting ring with high accuracy in all conditions of inclination;

it is extremely simple to assemble;

it allows even irregular expansions of the structure without inducing any overload of the mechanical parts.

The excellent centering between container and supporting ring allows the thermal expansions of the container caused by the high temperatures reached during the conversion process without any interference between container and supporting ring.

The suspension device of the converter, object of the present invention, further allows to fulfill the common requirement of all converters, i.e. that the entire structure of the converter, including protrusions, must be configured so as to be inscribed within a sphere (FIG. 1) the radius of which is determined by layout requirements of the plant comprising the converter.

The dependent claims describe preferred embodiments of the invention.

BRIEF DESCRIPTION OF THE FIGURES

Further features and advantages of the present invention will be more apparent in the light of the detailed description of a preferred, but not exclusive, embodiment of a suspension device and of a tilting converter illustrated by way of non-limitative example, with reference to the accompanying drawings, in which.

The same reference numbers in the figures identify the same elements.

DETAILED DESCRIPTION OF PREFERRED EMBODIMENTS OF THE INVENTION

Figure 1:
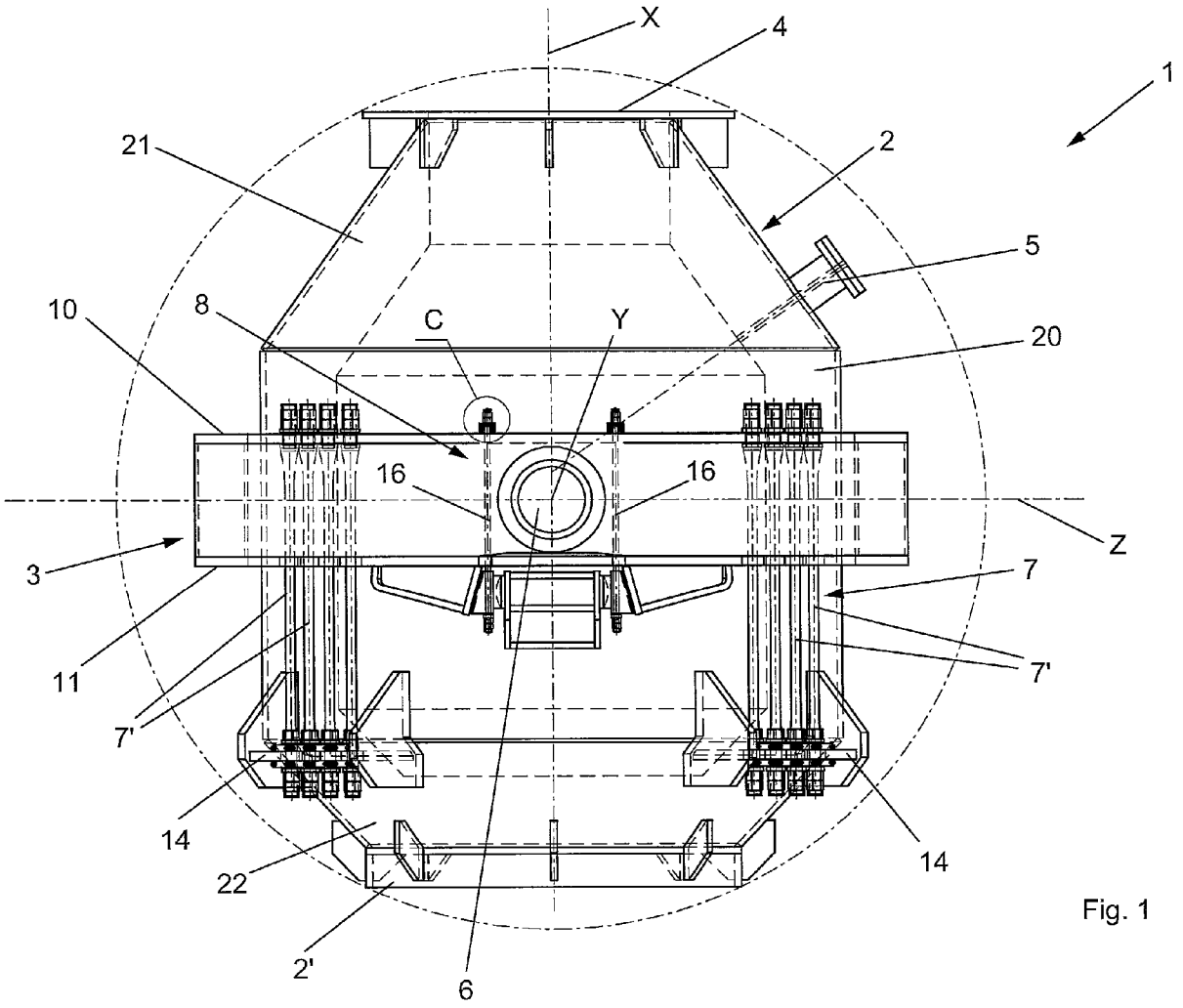
FIG. 1 shows a side view of a first embodiment of an oxygen converter according to the invention, in a vertical melting position, with the horizontal suspension devices provided underneath the supporting ring.

FIGS. 1 to 10 show a tilting converter, indicated by reference numeral 1 as a whole, comprising a first embodiment of a suspension device for the horizontal support of the converter, object of the present invention.

Such a converter 1 comprises:

a container or tank 2, defining an axis X, provided with a loading mouth 4 of the scrap and liquid cast iron and provided with a lateral tapping hole 5 of the liquid steel obtained at the end of the conversion process;

a supporting ring 3 for supporting the container 2, said ring 3 being arranged coaxially to the container 2 and appropriately distanced therefrom;

two supporting pins or tilting pins 6 of said supporting ring 3, known as trunnions, arranged diametrically opposite to each other and defining an axis Y, orthogonal to axis X, with at least one of said supporting pins 6 connected to a tilting mechanism (not shown);

the suspension devices 7, 8 which connect the container 2 to the supporting ring 3 and which also perform a centering function between container and ring.

A plane Y-Z, which may be considered "equatorial" of the converter, and a plane X-Z, both orthogonal to the plane X-Y, are identified defining a further axis Z as axis orthogonal to the plane X-Y and passing through the intersection point of axes X and Y.

Figure 4:
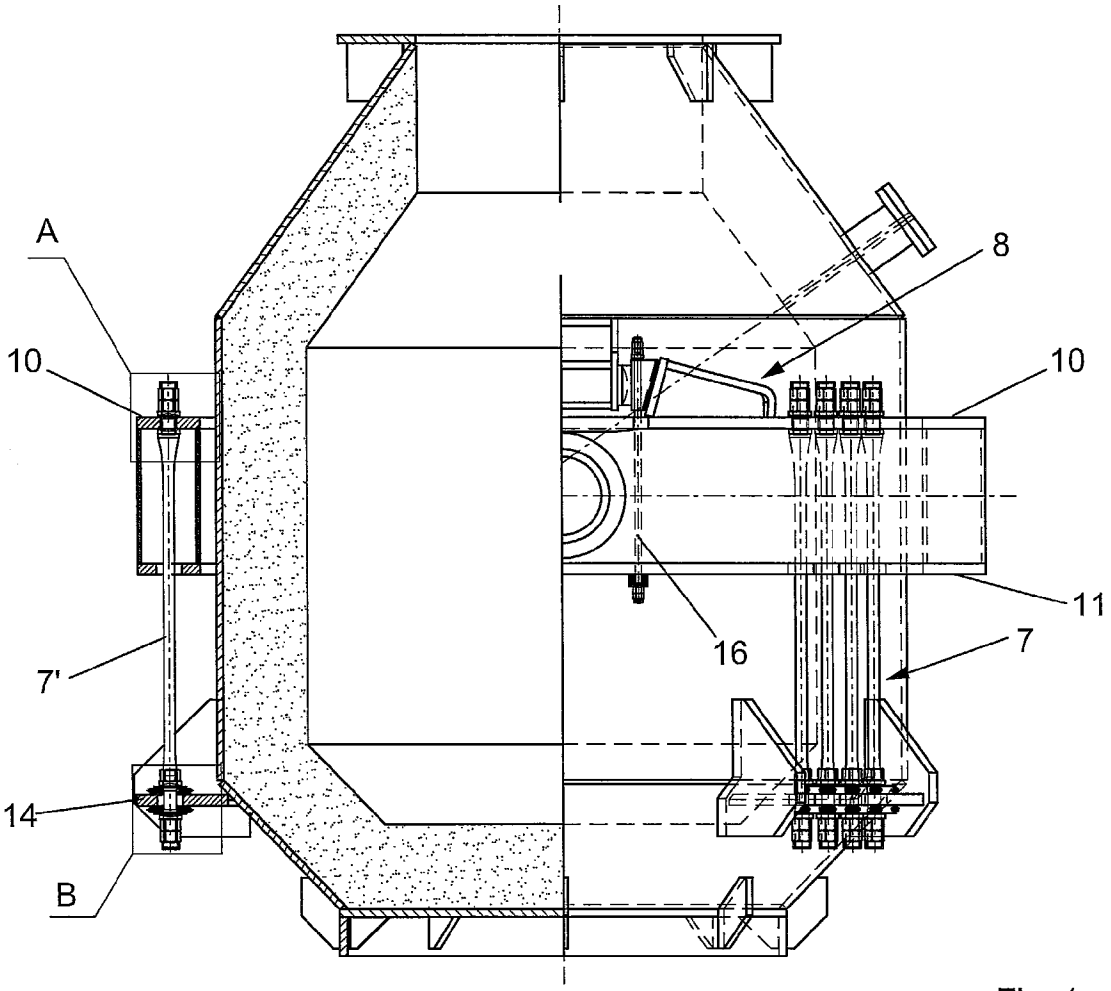
FIG. 4 shows a partially sectioned side view of the converter in FIG. 3.

The container 2, in the non-limitative example of FIGS. 1 and 4, comprises a cylindrical central zone 20 and two conical frustum-shaped zones 21, 22, each conical frustum-shaped zone being arranged by the side of said cylindrical central zone. A first conical frustum-shaped zone 21 is welded at an end to said central cylindrical zone 20 while the other end comprises the loading mouth 4 of the container. A second conical frustum-shaped zone 22 is welded at an end to said cylindrical central zone 20, on the opposite side to the first conical frustum-shaped zone 21, while the other end comprises the bottom 2' of the container 2.

Other examples of container may have a shape other than conical frustum in said second zone, e.g. a spherical-bowl shape or other appropriate geometric shape.

The supporting ring 3, arranged at the central zone 20 of the container 2, is empty and preferably has a rectangular cross section. The ring 3 has a first surface 10 facing towards the part of the container comprising the loading mouth 4; a second surface 11, opposite to the surface 10, facing the part of the container 2 comprising the bottom 2' thereof; a third inner surface facing the central part of the container; a fourth outer surface opposite to the inner surface.

Advantageously, the converter 1 is provided with at least two suspension devices 8 designed for horizontally supporting the converter according to a first variant of the invention.

Such suspension devices 8 comprise:

a central structure 8' fixed, for example by welding, to the container 2 of the converter 1, a first lateral structure 28 arranged at a first side of said central structure 8' and fixed, for example by welding, onto a first surface 10 (FIGS. 3 and 4) or 11 (FIG. 1) of the supporting ring 3 of the container, a second lateral structure 29 arranged at a second side of said central structure 8', opposite to the first side, and fixed, for example by welding, onto said first surface 10 (FIGS. 3 and 4) or 11 (FIG. 1) of the supporting ring 3.

The lateral structures 28 and 29 are arranged essentially symmetric with respect to the central structure 8'.

Advantageously, two wedge-shaped elements 15, or simply wedges 15, are provided, each wedge 15 being arranged between the central structure 8' and a respective lateral structure 28, 29 and configured so as to be able to slide on sliding surfaces 23, 24 connected respectively to the central structure 8' and to the respective side structure 28, 29.

Figure 2A:
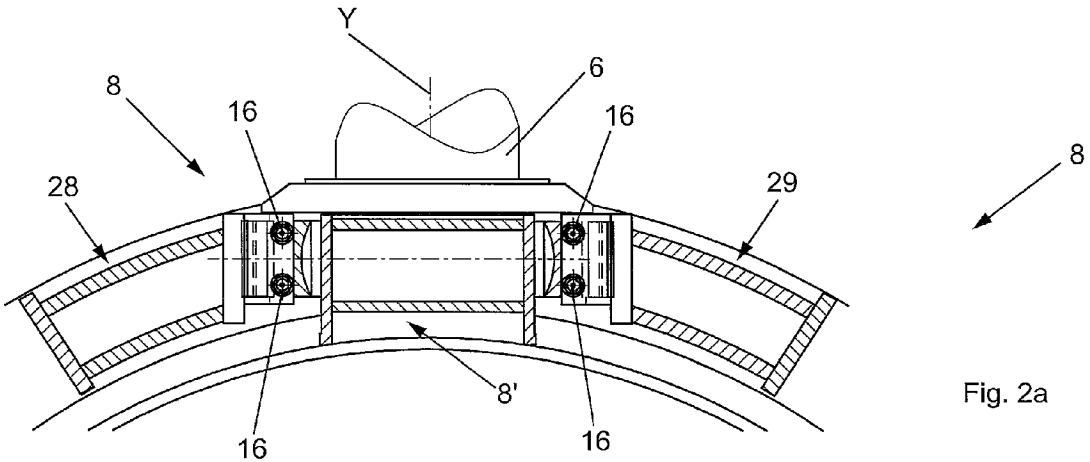
FIG. 2*a* shows a bottom section view of a first embodiment of a suspension device according to the invention.
Figure 2B:
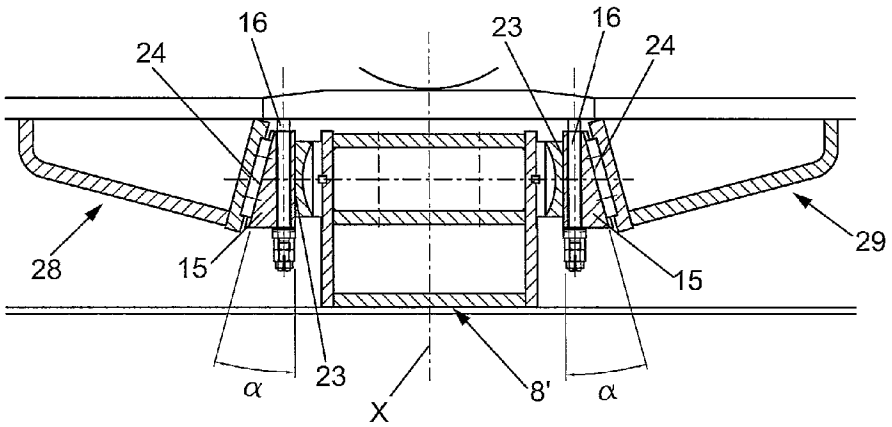
FIG. 2*b* shows a side section view of the suspension device in FIG. 2*a;*
Figure 2D:
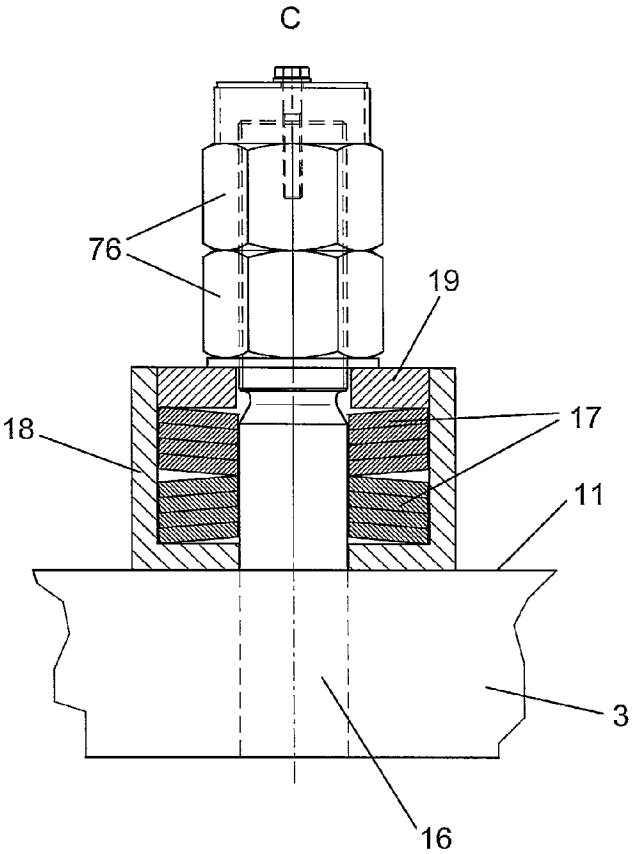
FIG. 2*d* shows an enlarged section view of part C in FIG. 1.
Figure 2C:
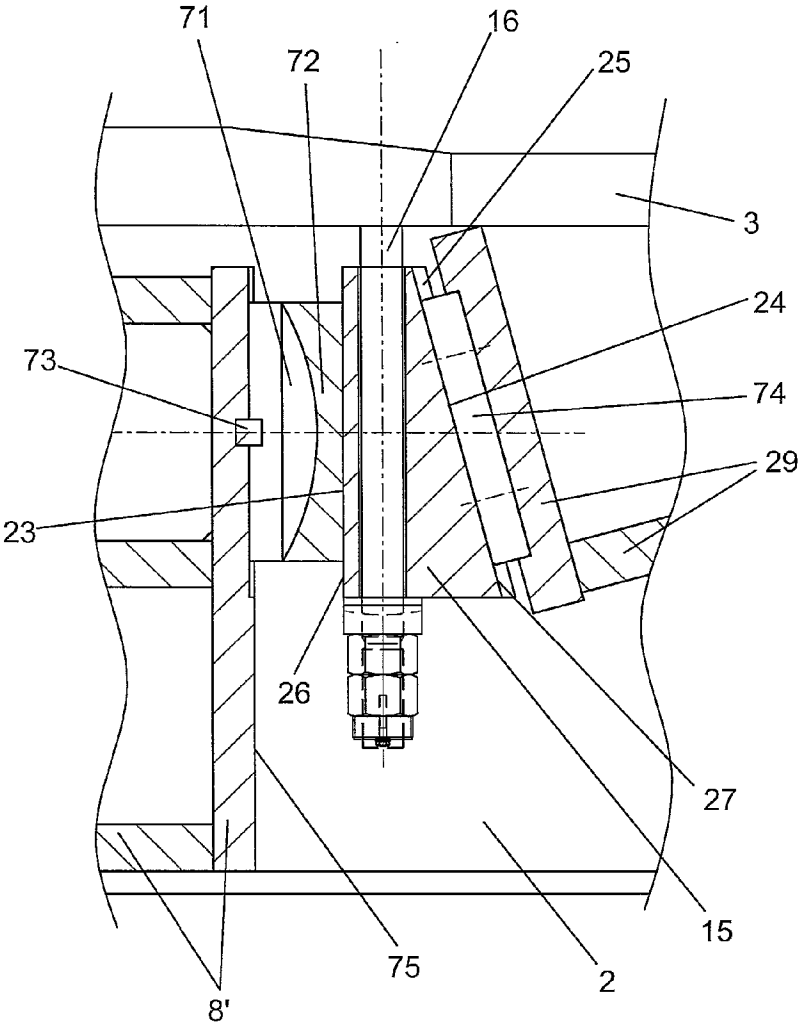
FIG. 2*c* shows an enlargement of a part in FIG. 2*a;*

A pair of spacers 71, 72, having essentially spherical-bowl shaped, reciprocally adjacent and joined surfaces, is provided between the central structure 8' and each wedge 15 (FIG. 2*c*). The inner spacer 71 is integrally fixed to a side 75 of the central structure 8', e.g. by means of a pin 73. The outer spacer 72 is freely arranged between inner spacer 71 and a surface of the wedge 15 and defines, with its outermost flat surface with respect to the plane X-Y, the sliding surface 23 for a first surface 26 of the wedge 15 parallel to the side 75 of the central structure 8'. The innermost surface of the spacer 72 has a concave shape and perfectly mates the convex-shaped outermost surface of the spacer 71. Such a spacer 72 is locked during the step of assembling between spacer 71 and wedge 15 and it is the coupling between the spherical-bowl-shaped surfaces which maintains the position and does not allow it to be released from its seat.

In particular, said sliding surface 23 allows the wedge to slide and to absorb the expansions of the container 2. The coupling of the spherical-bowl shaped joined surfaces of the spacers 71 and 72 allows instead to absorb the movements of the container which could cause swerving of the container with respect to the ring.

A further spacer 74 integrally fixed, e.g. by means of screws, to the lateral structure 29 is provided between the lateral structure 29 and each wedge 15 (FIG. 2*c*) and defines, with its innermost flat surface with respect to the plane X-Y, the sliding surface 24 for a second surface 27 of the wedge 15 which is inclined with respect to said first surface 26 by a predetermined angle $\alpha$, preferably comprised between 10 and 20°, preferably equal to approximately 15°.

In particular, the surface 27 of the wedge 15 facing the sliding surface 24 is delimited by side protrusions 25 which laterally delimit the spacer 74 so that said spacer 74 acts as a guide for the sliding of the wedge.

Advantageously, each wedge 15 is crossed by at least one tie-rod 16 connected thereto, preferably two tie-rods 16 as shown in FIG. 2*b*, defining a longitudinal axis thereof, essentially parallel to axis X. The tie-rods 16 entirely cross the wedges 15 along a direction parallel to axis X.

A first end of the tie-rods 16 is restrained to the wedge 15 during the step of assembling, e.g. by means of washers and tightening nuts, and the tie-rods 16 have a predetermined longitudinal extension so that they also cross the entire supporting ring 3.

A second end of the tie-rods 16 is indeed arranged externally to the supporting ring 3 in proximity of a second surface 11 (FIG. 4) or 10 (FIGS. 1 and 2*d*) thereof opposite to the first surface 10 (FIG. 4) or 11 (FIG. 1).

In a first variant of said first embodiment, said second end of the tie-rods 16 is surrounded by a cylindrical shaped housing 18 containing elastic means 17, appropriately preloaded by means of the tightening nuts 76 during the step of assembling. The housing 18 is fixed with a base thereof onto the surface 10 (FIG. 1) or 11 (FIG. 4) of the ring 3.

Said second end of the tie-rod crosses both the housing 18 and the elastic means 17 contained therein. A mobile closing plate 19 of the housing 18 is provided, arranged between the elastic means 17 and the tightening nuts 76 of the second end of the tie-rod, whereby the elastic means 17, preloaded during the step of assembling, extend by acting on the plate 19 allowing a translation of the tie-rod 16 and consequently a sliding of the wedge-shaped element 15 in a first direction, towards the ring 3, when clearances are produced between central structure 8' and lateral structures 28, 29 of the suspension device 8.

On the other hand, when compression overloads are produced between central structure 8' and one of the lateral structures 28, 29, the wedge 15, and thus the tie-rods 16, will tend to slide in a second direction, opposite to said first direction, and the plate 19 will press the elastic means 17 inside the housing 18. The elastic means 17 comprise, for example Belleville washers or volute springs or helical springs with circular or square section wire or any other type of springs suitable to maintain the mechanical tension constant also in the presence of thermal stress and to allow to relieve a great force in very small spaces.

The wedges 15 of the suspension devices 8 are thus maintained compressed whereby the suspension device is automatically adjusted as the expansions which are produced during the operation of the converter between central structure 8' and lateral structures 28, 29, i.e. between container 2 and supporting ring 3, vary.

In a second variant of said first embodiment, the elastic means which maintain the wedges 15 of the suspension devices 8 compressed do not comprise springs but are instead defined by the tie-rods 16 themselves which cross the wedges 15. In these cases, it is the elasticity of the tie-rod itself to maintain the mechanical tension constant also in the presence of thermal stress, and allow to relieve a high force even in very small spaces. The elasticity of the tie-rods 16 thus maintains the wedge-shaped elements compressed.

FIGS. 11 to 14 show a tilting converter, indicated by reference numeral 1' as a whole, comprising a second embodiment of a suspension device for the horizontal supporting of the converter object of the present invention.

Such a converter 1' comprises all the features of the converter 1, described above, except for the fact that the zone 22' of the converter 2, containing the bottom of the container, is spherical-bowl-shaped and not conical frustum-shaped. Also in this case, the zone 22' of the container may alternatively have any appropriate geometry shape.

Advantageously, the converter 1' is provided with at least two suspension devices 8 designed for horizontally supporting the converter according to a second variant of the invention.

Such suspension devices 8 comprise:

a central structure 8' fixed, for example by welding, to the container 2 of the converter 1, a first side structure 28, arranged at a first side of said central structure 8', and fixed, for example by welding, to the second surface 11 of a supporting ring 3 of the container, a second side structure 29 arranged at a second side of said central structure 8', opposite to the first side, and fixed, e.g. by welding, to said second surface 11 of the ring 3.

The lateral structures 28 and 29 are arranged essentially symmetric with respect to the central structure 8'.

Advantageously, two wedge-shaped elements 15', or simply wedges 15', are provided, each wedge 15' being arranged between the central structure 8' and a respective lateral structure 28, 29 and configured so as to be able to slide on sliding surfaces 23, 24' connected respectively to the central structure 8' and to the respective side structure 28, 29.

Figure 14A:
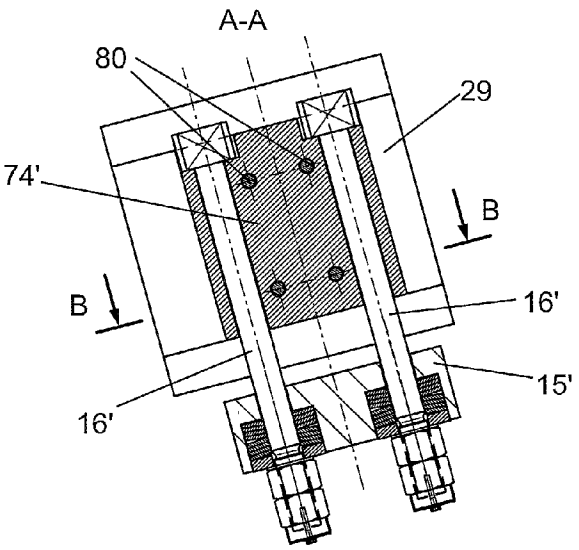
FIG. 14*a* shows a section view taken along the plane A-A of part of the device in FIG. 14.
Figure 14B:
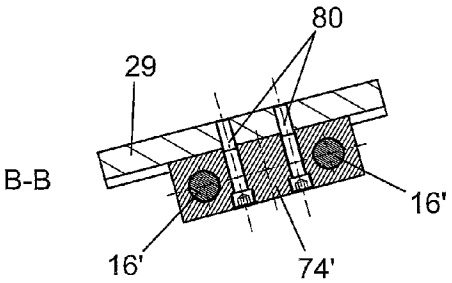
FIG. 14*b* shows a section view taken along plane B-B of the part shown in FIG. 14*a*.
Figure 14:
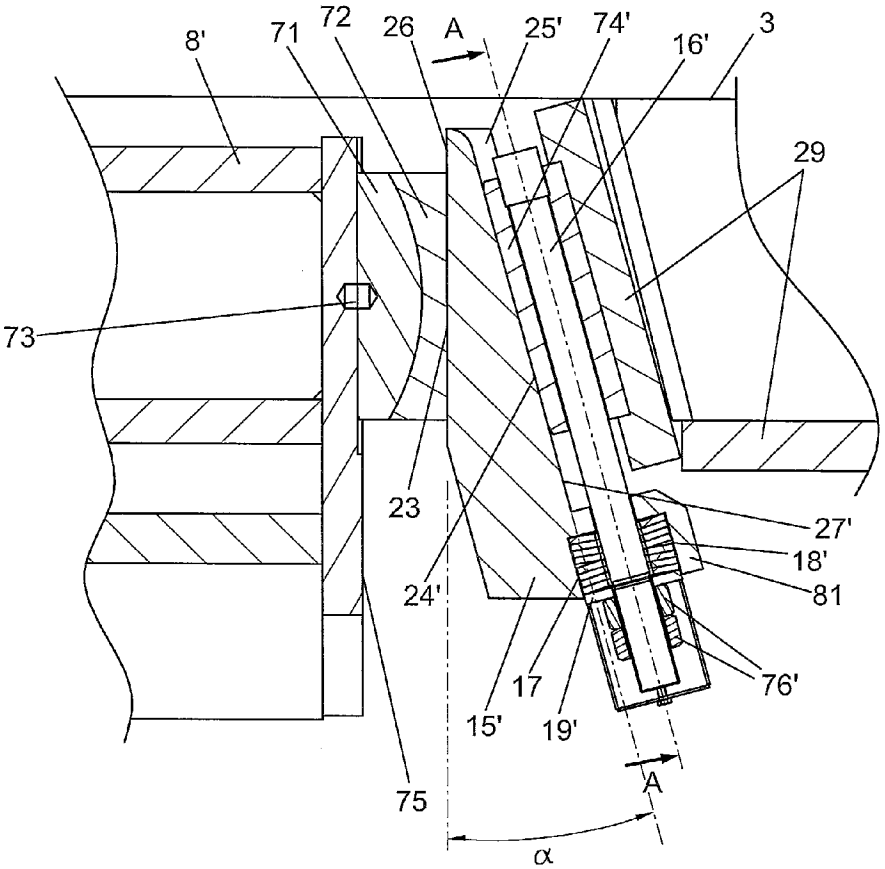
FIG. 14 shows an enlarged section view of part of the device in FIG. 13*b;*

A pair of spacers 71, 72, having essentially spherical-bowl shaped, reciprocally adjacent and joined surfaces, is provided between the central structure 8' and each wedge 15' (FIG. 14). The description provided for the first embodiment of the suspension device applies to these spacers 71, 72.

Also in the case of this variant, the sliding surface 23 allows in particular to absorb the expansions of the container 2. The coupling of the spherical-bowl shaped joined surfaces of the spacers 71 and 72 allows instead to absorb the movements of the container which could cause swerving of the container with respect to the ring.

A further spacer 74' integrally fixed, e.g. by means of screws 80, to the lateral structure 29 is provided between the lateral structure 29 and each wedge 15' (FIG. 14) and defines, with its innermost flat surface with respect to the plane X-Y, the sliding surface 24' for a surface 27' of the wedge 15' which is inclined with respect to the surface 26 of the wedge 15', sliding on the sliding surface 23, by a predetermined angle α, preferably comprised between 10 and 20°, preferably equal to approximately 15°.

In particular, the surface 27' of the wedge 15', facing the sliding surface 24', is delimited by side protrusions 25' which laterally delimit the spacer 74' whereby said spacer 74' acts as guide for the sliding of the wedge 15'.

Advantageously, each wedge 15' is crossed by at least one respective tie-rod 16' connected thereto, preferably two tie-rods 16' as shown in FIG. 14*a*, defining a longitudinal axis thereof, essentially parallel to axis X. The tie-rods 16' cross in this variant only one protrusion 81 of the portion of greater thickness of the wedge 15' (FIG. 14) and not the entire wedge 15'.

The tie-rods 16' are provided in a fixed-end configuration within the spacer 74' (FIGS. 14, 14*a*, 14*b*) at a first end thereof and are therefore integrally fixed to the corresponding lateral structure 28 or 29.

In a first variant of said second embodiment, the elastic means 17 are connected to a second end of the tie-rods 16' and positioned in a housing 18' provided in a recess of the protrusion 81 of the wedge 15'. The elastic means 17 are preloaded during the step of assembling, and said second end of the tie-rod crosses both the cylindrical-shaped housing 18' and the elastic means 17 contained therein.

A fixed closing plate 19' of the housing 18' is arranged between the elastic means 17 and the tightening nuts 76' of the second end of the tie-rod, whereby the elastic means 17, being the tie-rod fixed, extend acting on the wedge 15', determining a sliding in a first direction towards the surface 11 of the supporting ring 3. This occurs when clearances are produced between central structure 8' and lateral structures 28, 29 of the suspension device 8. Vice versa, when compression overloads are produced between central structure 8' and one of the lateral structures 28, 29, the wedges 15' will tend to slide in a second direction, opposite to said first direction, thus pressing the elastic means 17 on the fixed plate 19' inside the housing 18'. The elastic means 17 may be, for example, Belleville washers or volute springs or helical springs with circular or square section wire or any other type of springs suitable to maintain the mechanical tension constant also in the presence of thermal stress and to allow to relieve a great force also in very small spaces.

Therefore, also in this second embodiment, the wedges 15' of the suspension devices 8 are maintained compressed whereby the suspension device is automatically adjusted as the expansions, which are produced during the operation of the converter between central structure 8' and lateral structures 28, 29 during the operation of the converter, i.e. between container 2 and supporting ring 3, vary.

In a second variant of said second embodiment, the elastic means which maintain the wedges 15' of the suspension devices 8 compressed do not comprise springs but are instead defined by the tie-rods 16' themselves which cross the wedges 15'. In these cases, it is the elasticity of the tie-rod itself to maintain the mechanical tension constant also in the presence of thermal stress, and allow to relieve a high force even in very small spaces. The elasticity of the tie-rods 16' thus maintains the wedge-shaped elements compressed.

Advantageously, in both embodiments of the suspension device 8, object of the present invention, the angle α defined by the wedges 15, 15' is greater than the friction angle, whereby there is always a free sliding of the wedges which allows in any condition to compensate clearances or prevent possible compression overloads between the parts fixed to the container and those fixed to the supporting ring. The action of the friction in all cases is essential when the converter is turned by 90° (position in FIG. 9) because it prevents the load deriving from the weight of the container from weighing entirely on the tie-rods 16, 16' and on the elastic means 17.

A further advantage is represented in that in the converter of the invention, in all embodiments thereof, the suspension devices 7 for vertically supporting the converter are longitudinal bars 7' provided in a fixed-end configuration and restrained at a first end to the container 2 and at a second end to the supporting ring 3. The bars 7' are locked at the ends to prevent the presence of relative moving parts, and, as there are not parts subjected to wear, maintenance activities are cancelled or at least considerably reduced. The bars 7', acting as tie rods or struts, are adjustable to compensate for possible lack of uniformity of the bar length, thus guaranteeing a correct positioning thereof during assembly.

Said bars are appropriately dimensioned to operate as elastic supporting means to absorb expansions.

Said longitudinal bars 7' preferably have a circular section. However, other section shapes may by provided according to the designed longitudinal extension of the bars.

The bars 7' are advantageously made of high-alloy steel, such as spring steel with high yield strength or other suitable steel with similar elasticity properties. Furthermore, the bars may be thermally treated (e.g. by means of hardening and tempering or solution heat-treatment according to the type of steel used) and may be provided with a surface coating, e.g. based on nickel, chrome or other suitable element. The high-quality material used allows to withstand very well not only mechanical stress but also oxidation which is very important in the context of oxygen converters.

Figure 3:
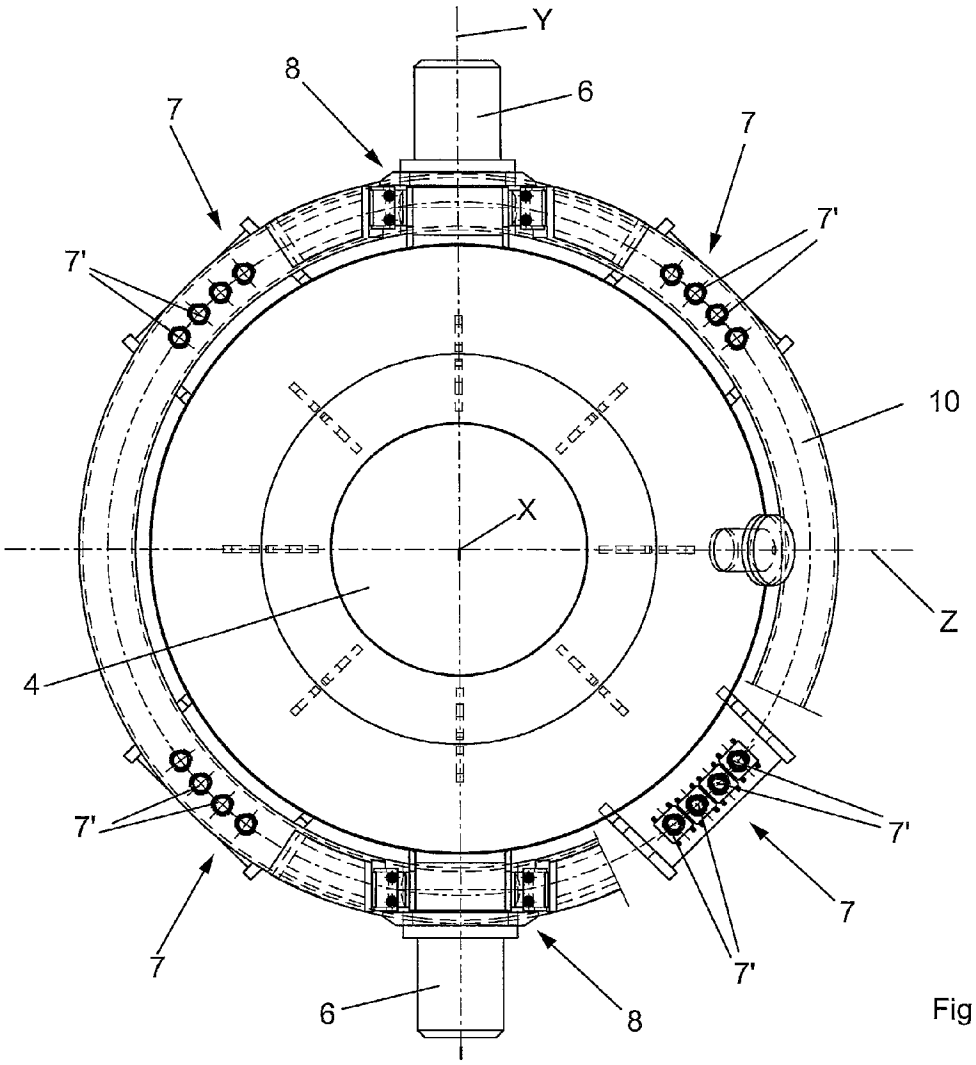
FIG. 3 shows a top view of a variant of the converter in FIG. 1, with the horizontal suspension devices provided above the supporting ring.
Figure 12:
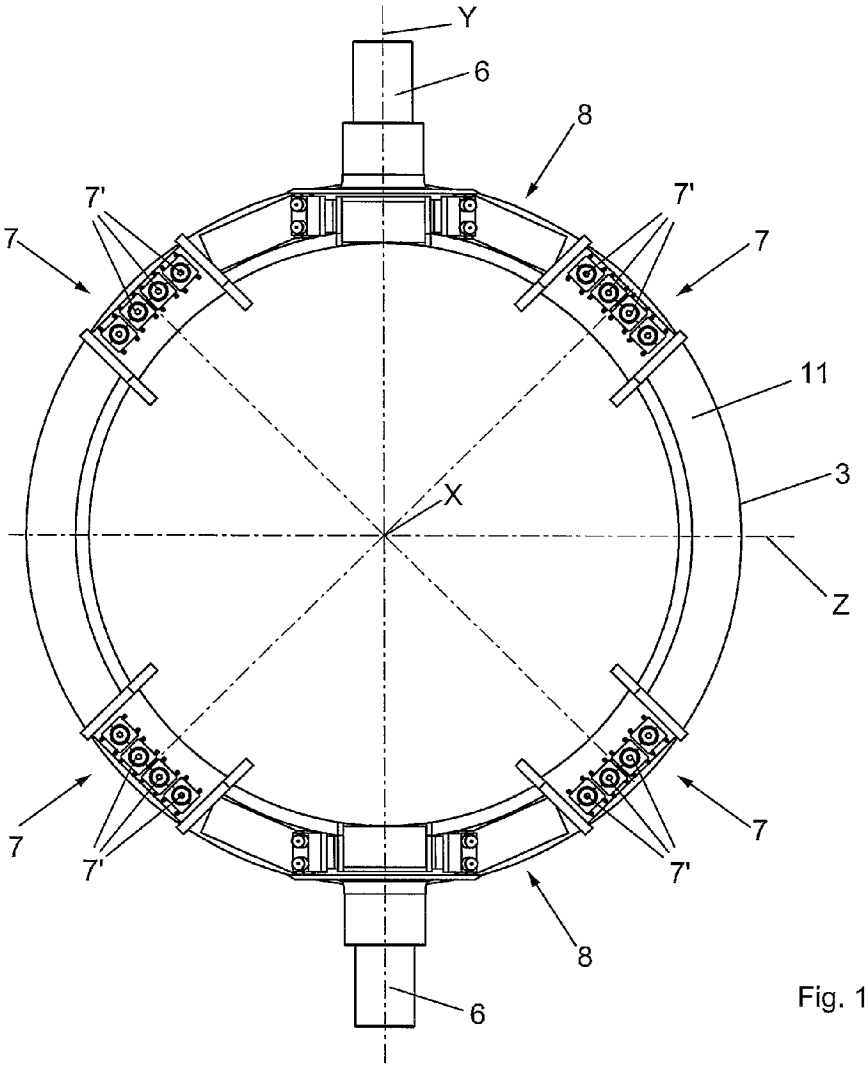
FIG. 12 shows a bottom view of the converter in FIG. 11.
Figure 13A:
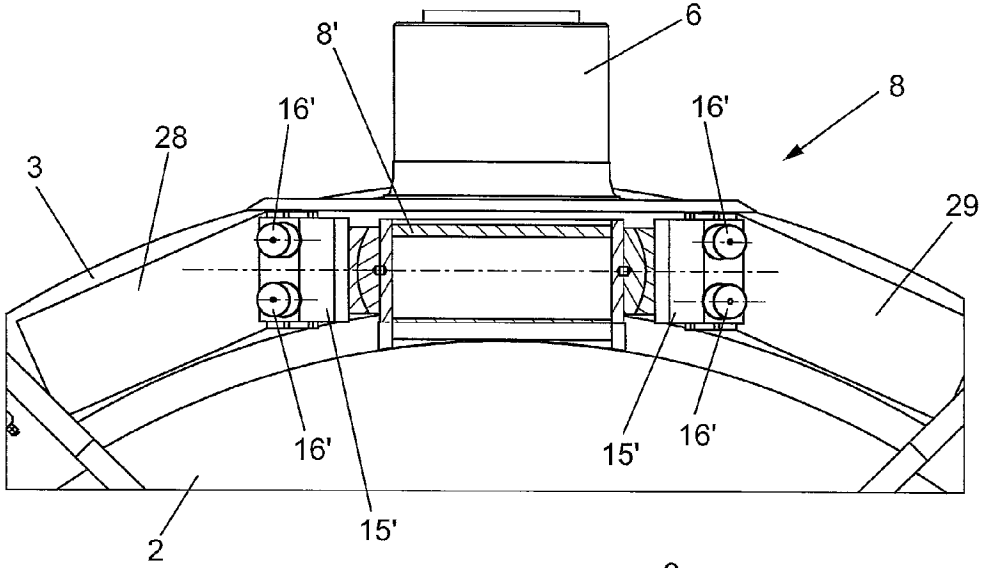
FIG. 13*a* is a bottom partially sectioned view of a second embodiment of a suspension device according to the invention.
Figure 13B:
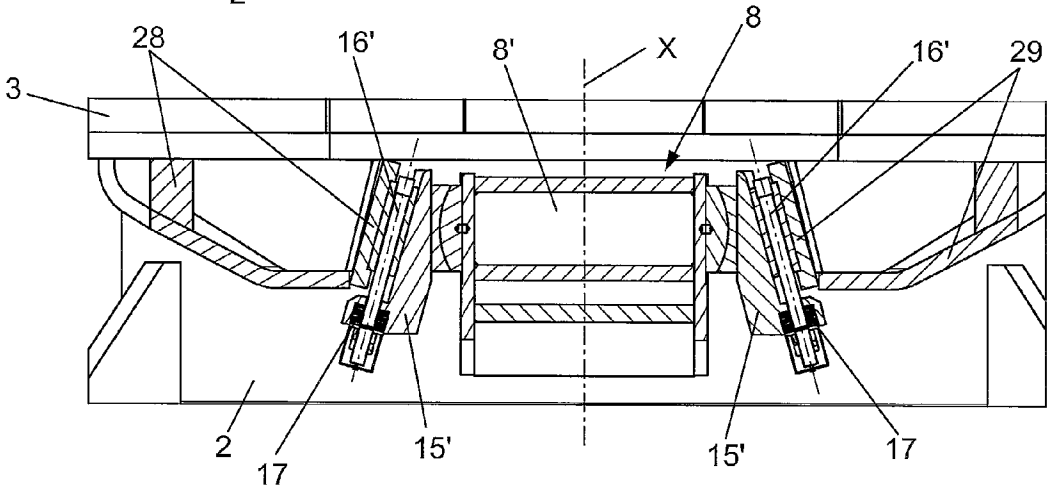
FIG. 13*b* shows a partially sectioned side view of the suspension device in FIG. 13*a;*

With reference to FIGS. 3 and 12, an advantageous configuration of the converter of the invention includes:

- four groups of elastic bars 7' arranged parallel to axis X and at an equal angular distance between one group and the next (90°);
- a pair of suspension devices 8, said suspension devices 8 being arranged each at a respective supporting pin 6, symmetrically with respect to the plane X-Z on a respective plane parallel to plane Y-Z.

Figure 11:
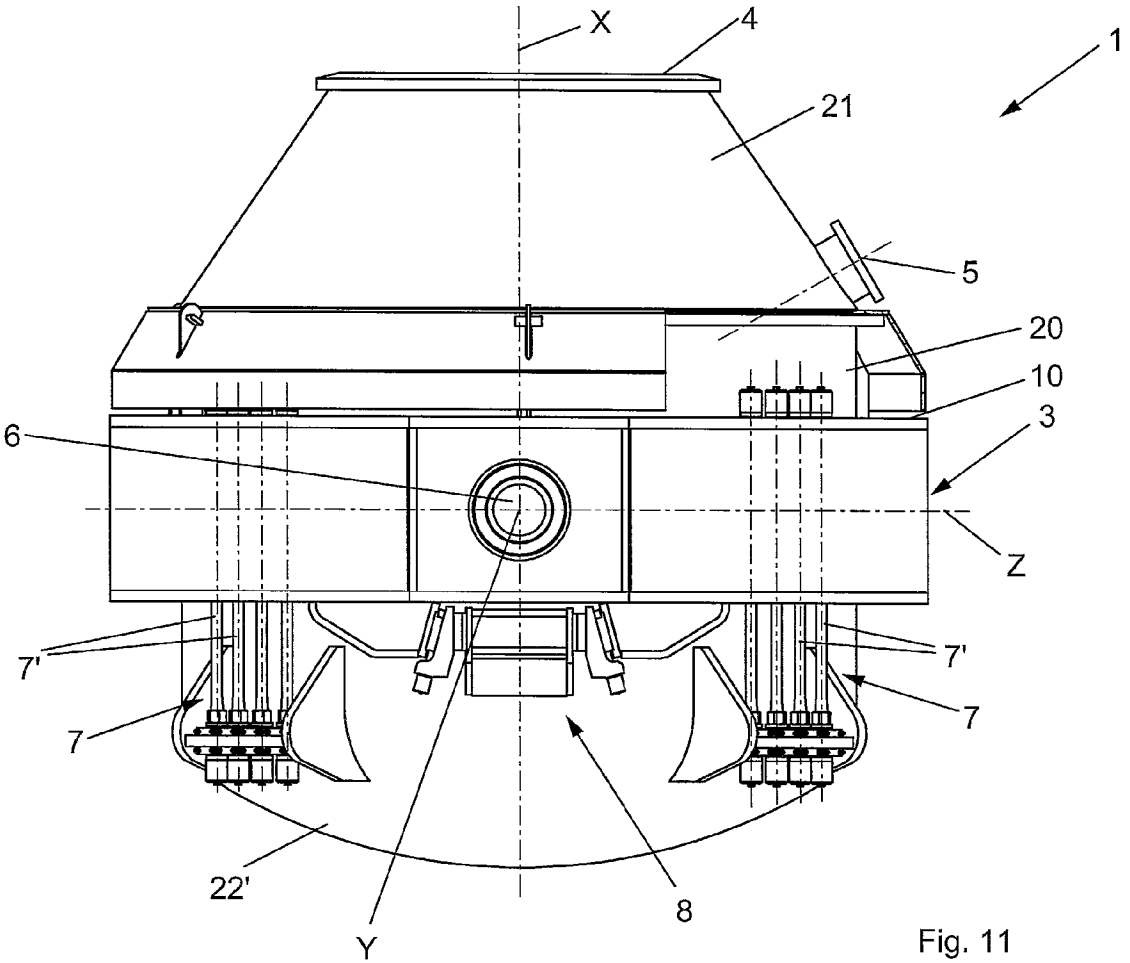
FIG. 11 shows a side view of a second embodiment of an oxygen converter according to the invention in a vertical melting position.

Each suspension device 8 is provided in the space comprised between two groups of elastic bars 7' and is arranged in proximity of the first surface 10 of the ring 3 (FIG. 3). Alternatively, each suspension device 8 may be arranged near the second surface 11 of the ring (FIGS. 1 and 11).

The four groups of elastic bars 7' are arranged such that two pairs of groups of bars 7' are mutually arranged symmetrically with respect to the plane X-Y.

Another advantageous configuration (not shown) of the converter includes two pairs of suspension devices 8, a first pair of suspension devices 8 being arranged at a first side of the plane Y-Z and a second pair of suspension devices 8 being arranged at a second side of the plane Y-Z. Furthermore, the suspension devices 8 are arranged symmetrically with respect to the plane X-Z. Considering the converter in vertical position, the bars 7' are arranged in vertical position while the suspension devices 8 are arranged in horizontal position. The bars 7' cross the plane Y-Z orthogonally. The suspension devices 8 are instead parallel to the plane Y-Z and cross the plane X-Y. In particular, one pair of suspension devices 8 is arranged at a first side of the plane Y-Z, i.e. above the plane Y-Z and the supporting ring 3 when the converter is in vertical or straight position; while another pair of the suspension devices 8 (not shown) is arranged at a second side of the plane Y-Z, i.e. below the plane Y-Z and the supporting ring 3 when the converter is in the vertical or straight position.

In the variants shown in the Figures, the four groups of elastic bars 7', having four bars each, are mutually arranged at 90° to provide an isostatic balance, i.e. a balanced distribution of the loads for each group of elastic bars.

The number of bars may be increased in the case of particularly high loads instead of designing thicker longitudinal elastic bars which would have lower elasticity. These groups of bars 7' are also essentially arranged mutually at 90° to continue to provide an isostatic balance. A higher number of thin bars would allow to distribute the load in optimal way, while maintaining a suitable elasticity of the bars.

All suspension devices 7, 8 are arranged, in plan view, essentially along a circumference (FIGS. 3 and 12). They are thus essentially arranged along the side surface of a cylinder.

The elastic bars 7' of the suspension devices 7 are restrained at an end to the container 2 by locking onto the fastening supports 14. They are instead restrained at the other end by locking directly onto the first surface 10 of the supporting ring 3. The restraint is a fixed-end configuration (fixed-end beam). Both the fastening surfaces 14, either welded or bolted to the container 2, and the first surface 10 of the ring 3 have through holes in which elastic bars 7' are inserted; the ends of such bars are threaded and they are locked onto the supports 14 and onto the first surface 10 of the ring by means of a self-aligning locking system and nuts, described below. The elastic bars 7' cross, with at least one end thereof, the cavity of the ring 3, optionally within a respective sleeve having the function of delimiting the passage channel of the respective bar 7'. Advantageously, a single fastening support 14 may be provided for each group of elastic bars 7'.

With reference to FIGS. 1 and 11 (converter in vertical position), the elastic bars 7' are fixed to the container 2 in a position underneath the supporting ring 3, i.e. underneath the plane Y-Z; while they are fixed to the ring 3 directly onto the first surface 10 thereof, i.e. above the plane Y-Z.

The two supporting pins 6, actuated by at least one tilting mechanism, allow the rotation of the converter about axis Y.

The converter usually passes from a first position in which it is in its vertical position with the loading mouth 4 facing upwards (FIG. 1) to a second position inclined by approximately 30° with respect to the vertical 40 (FIG. 8), by means of a rotation of the supporting pins 6 in a sense of rotation. In the position in FIG. 8, the cast iron and scrap is loaded through the mouth 4. The converter returns to the first position in FIG. 1 after loading. One or more lances, introduced into the container through the mouth 4, blow oxygen for a given period of time so as to drastically lower the carbon content and reduce the concentration of impurities such as sulfur and phosphorus. Once the conversion into liquid raw steel has been completed, the converter passes from the first position in FIG. 1 to a third position (FIG. 9) inclined by approximately 90° with respect to the vertical 40, by means of the rotation of the supporting pins 6 in said sense of rotation. In this third position, the liquid steel is tapped through the tapping hole 5.

In all variants of the invention, shown in the Figures, the load, determined by the sum of the weights of the container 2, the liquid cast iron and the scrap, is relieved onto the ground by means of the supporting ring 3, the elastic bars 7', the suspension devices 8, the tilting pins 6 and the respective supports.

In particular, the configuration of the elastic bars 7' and of the suspension devices 8 allows to absorb the weight at any inclination of the container 2.

The elastic bars 7' act exclusively as tie-rods for an inclination angle of the converter with respect to the vertical equal to 0°, while they acts only as struts for an inclination angle equal to 180°, and gradually both as tie-rods and as struts for different angles from 0° and 180°.

Figure 10:
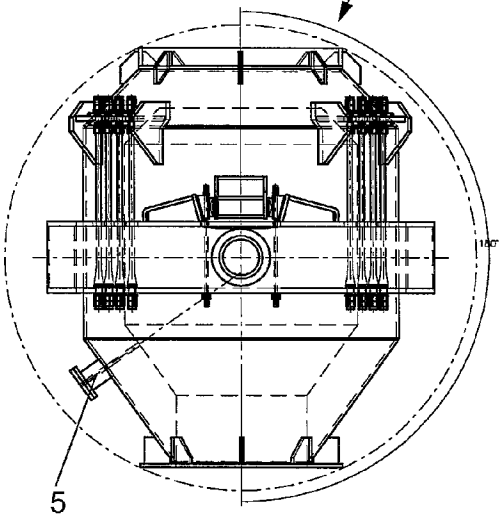
FIG. 10 shows the converter in FIG. 1 in a third operative slag unloading position.
Figure 8:
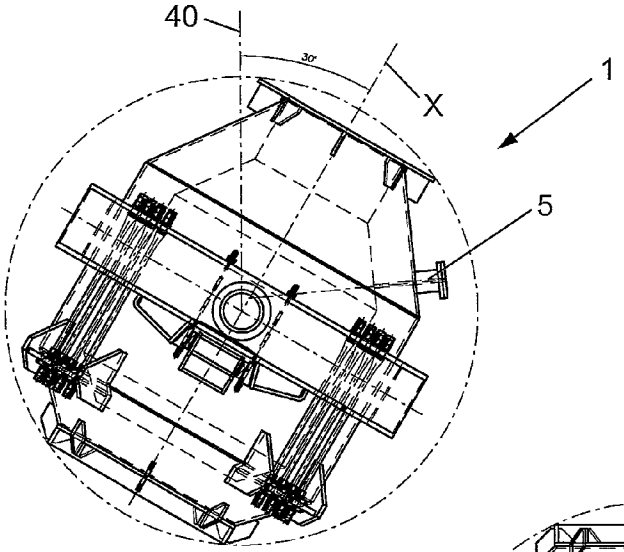
FIG. 8 shows the converter in FIG. 1 in a first operative position of loading cast iron and scrap.

The position with inclination angle equal to 180°, shown in FIG. 10, with the loading mouth 4 facing downwards, is provided for cleaning operations of the container once emptied.

The suspension devices 8 guarantee an optimal support, stability and rigidity of the container. The main purpose of said suspension devices 8 is to support the weight of the container in direction crosswise to axis Y when it is inclined by 90° (tapping position, e.g. FIG. 9) and to support the load component orthogonal to axis X of the converter in all other conditions. These loads are mainly absorbed by the sliding surfaces 23, which allow in particular to absorb the expansions of the container 2.

The suspension devices 8 also provide the function of preventing possible movements/oscillations on the horizontal plane when the converter is inclined by 90° for the step of tapping of the liquid steel.

In general, the load on the elastic bars 7' gradually passes from a maximum value with converter in vertical position to a zero value with converter in horizontal position, while the load on the suspension devices 8 passes gradually from zero to a maximum value when the converter passes from the horizontal position to the vertical position.

The moments which are generated with the rotation of the converter about axis Y are perfectly absorbed by the embodiments of suspension devices 7 and 8 described above. The coupling of the spherical-bowl shaped joined surfaces of the spacers 71 and 72 allows to absorb the movements of the container which could cause swerving of the container with respect to the ring.

A further advantage is that all the longitudinal elastic bars 7' are restrained in a fixed-end configuration and provided with an innovative self-aligning locking system at the two end supports for the axial closure and for compensating misalignments.

As both the fastening supports 14 and the inner and outer surfaces of the supporting ring 3 are generally made using low precision machine tools, they display machining errors with very approximate parallelism tolerances and/or shape irregularities. For this reason, the resting planes of the end supports of the bars 7' may not be perfectly parallel and thus converge.

For example, taking the ends of the bars 7' (FIGS. 4*a* and 4*b*) into account, the outer resting surface 10 and the inner resting surface 10' of the first end support 60 (FIG. 4*a*), belonging to the supporting ring 3, may not be perfectly parallel to each other, causing a discontinuous resting surface of the locking elements and subsequent clearances detrimental to wear resistance and stability of the tie-rod. The outer 40 and inner 40' resting surfaces of the second end support 60' (FIG. 4*b*), part of the fastening support 14, may also display machining errors or shape irregularities. Furthermore, there may also be distance errors between the outer surface 10 of the end support 60 and the outer surface 40 of the end support 60'.

Each tie-rod or strut of the suspension devices 7 of the converter of the invention comprises:

- a longitudinal elastic bar 7', provided with threaded ends 47, 48;
- locking elements to lock the ends of the bar to respective end supports 60, 60';
- a pair of flanges or resting shims 44, 45 which, in the fixed-end tie rod configuration, are arranged at the end support 60', said end support 60' being interposed between the two flanges 44, 45.

The longitudinal bar 7' (FIGS. 4*a*, 4*b*, 5) comprises a central portion 46, delimited on one side by a shoulder 52 and on the other side by an intermediate threaded portion 49, and two lateral portions 50, 51 having reciprocally different longitudinal extension along the axis X.

Figure 4B:
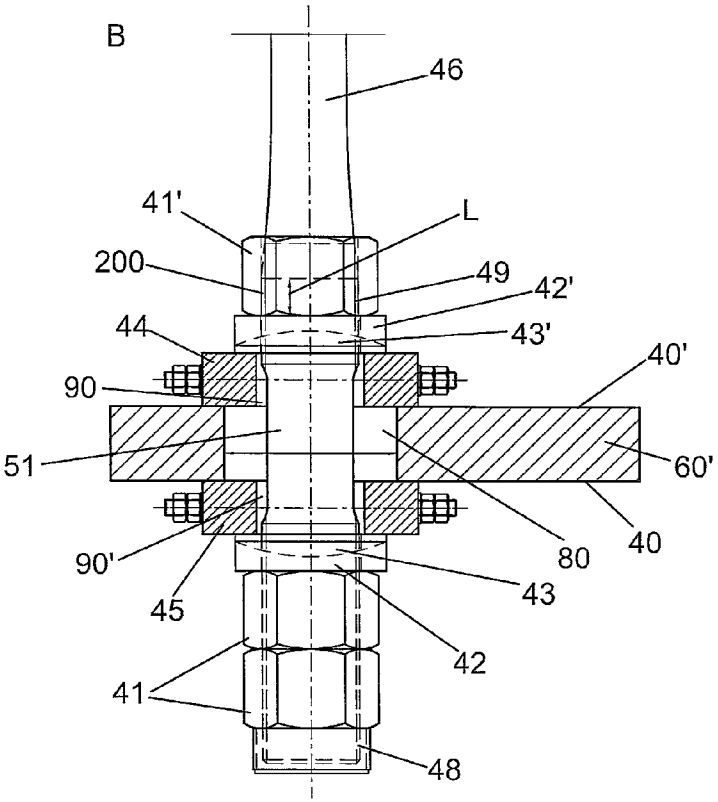
FIG. 4*b* shows an enlarged section view of a second part in FIG. 4.
Figure 4A:
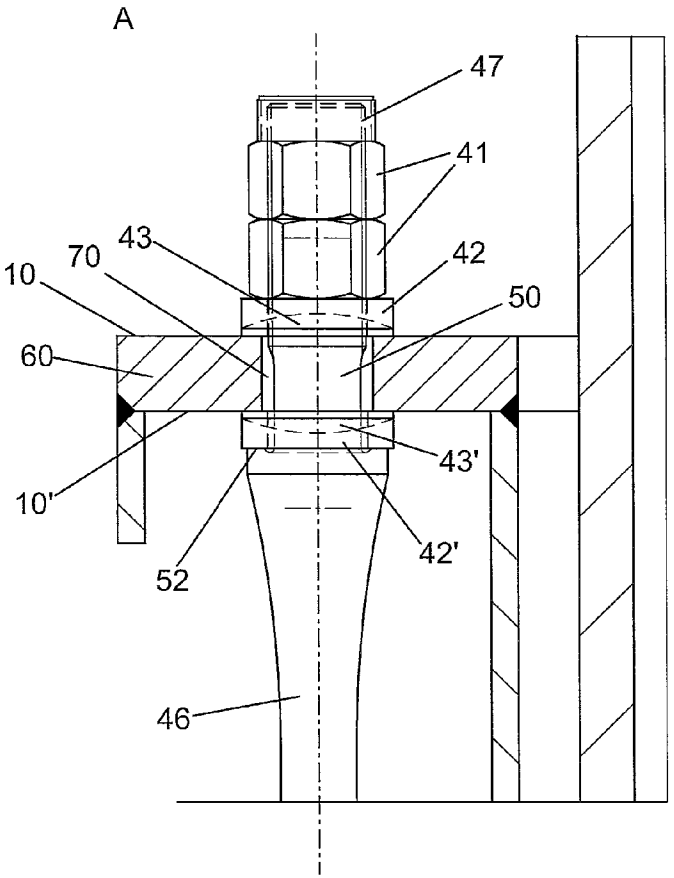
FIG. 4*a* shows an enlarged section view of a first part in FIG. 4.

The lateral portion 50 is arranged between the threaded end 47 and the corresponding shoulder 52 and has a longitudinal extension along the axis X essentially equal to the longitudinal extension of the hole 70 provided in the end support 60 (FIG. 4*a*). The diameter of the lateral portion 50 is smaller than that of the adjacent threaded end 47.

The lateral portion 51, instead, is arranged between the threaded end 48 and said threaded intermediate portion 49 and has a longitudinal extension along the axis X longer than the longitudinal extension of the lateral portion 50 and slightly longer than the sum of the longitudinal extensions of the three holes 80, 90, 90' (FIG. 4*b*), provided in the respective end support 60' and in the two flanges 44, 45, respectively. The diameter of the lateral portion 51 is smaller than the diameter of the adjacent threaded ends 48 and of the intermediate threaded portion 49.

The locking elements comprise at each end of the bar 7':

- two pairs of spacers 42, 43 and 42', 43', each pair of spacers advantageously having joined surfaces to each other 53, 54 and 53', 54 substantially in the shape of an annular portion of a spherical-bowl (FIGS. 6 *e* 7);
- and at least two tightening nuts 41.

In a fixed-end tie rod configuration, the following are provided at each end support:

- a first pair of spacers 42, 43 arranged at an external side of the respective end support,
- a second pair of spacers 42', 43' arranged at an internal side of the respective end support.

Advantageously, the first pair of spacers and the corresponding second pair of spacers are arranged symmetrically with respect to the interposed end support, and the radius of the pair of joined surfaces 53, 54 of the first pair of spacers is equal to the spherical-bowl radius of the pair of joined surfaces 53', 54' of the second pair of spacers, said pair of joined surfaces being in all cases arranged on different spherical surfaces. Each longitudinal elastic bar 7' is clamped (non-spherical joint) by means of an innovative locking system to the two end supports for the axial closure and compensation of misalignments.

Said at least two tightening nuts 41 are externally tightened onto the first pair of spacers 42, 43, i.e. onto the external pair of spacers.

Figure 5:
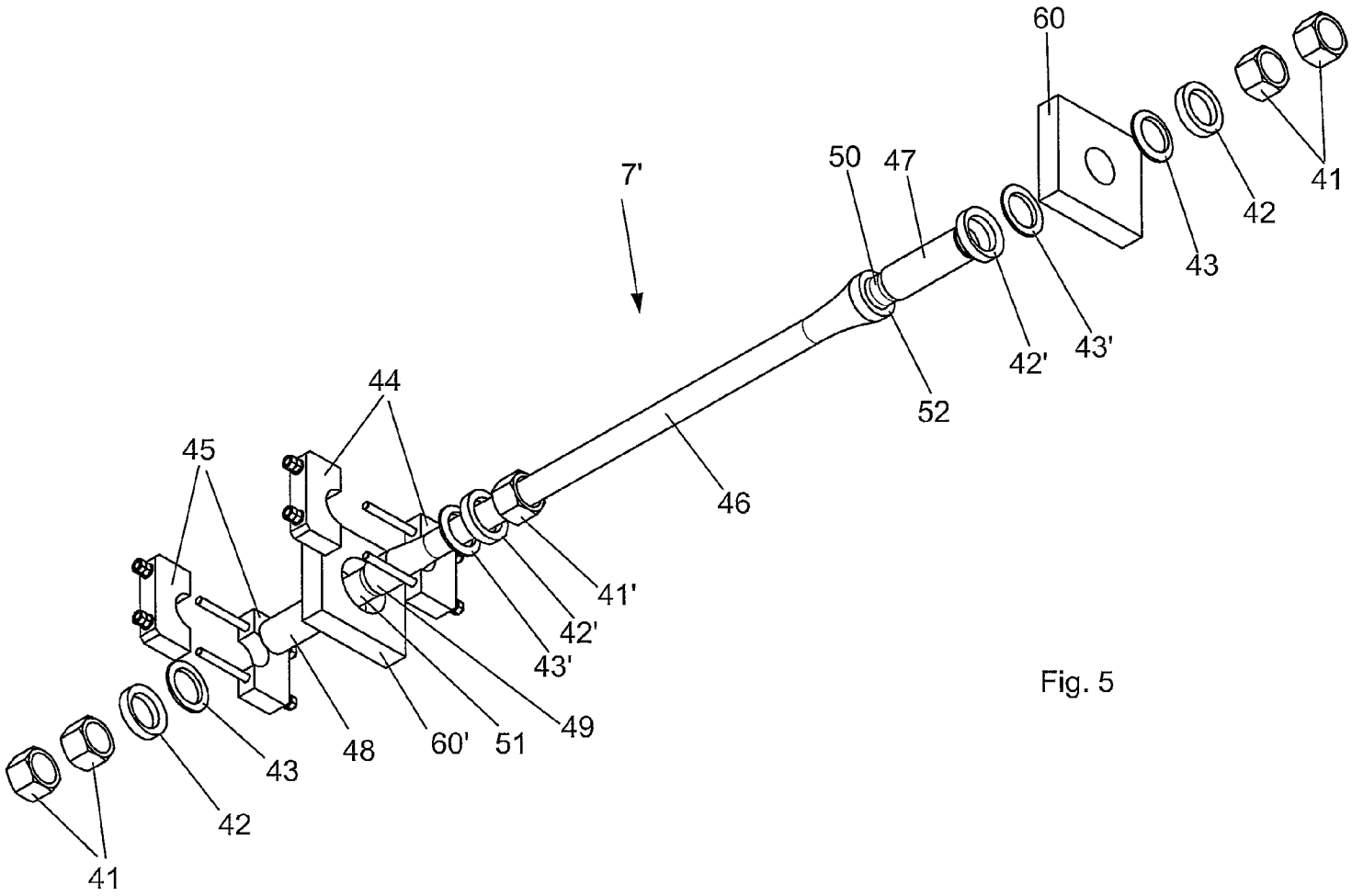
FIG. 5 shows an exploded perspective view of a component of the converter according to the invention.
Figure 7:
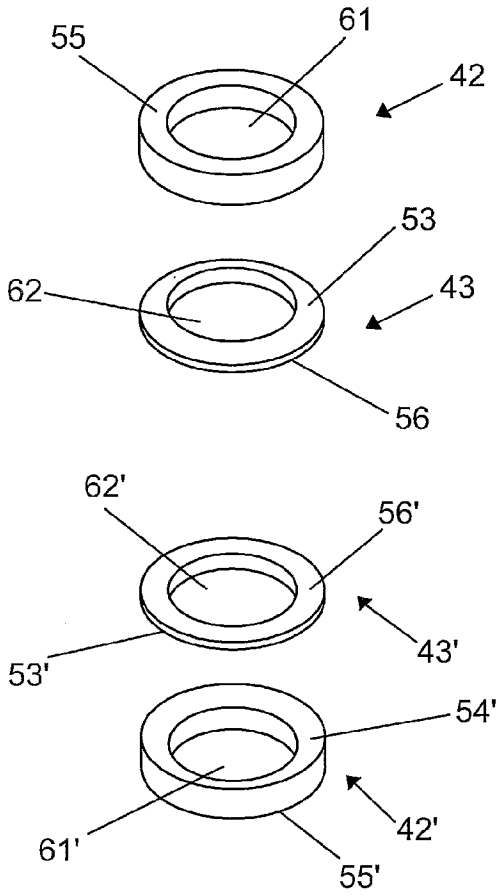
FIGS. 6 and 7 show side and perspective exploded views, respectively, of some elements of the component of FIG. 5.
Figure 6:
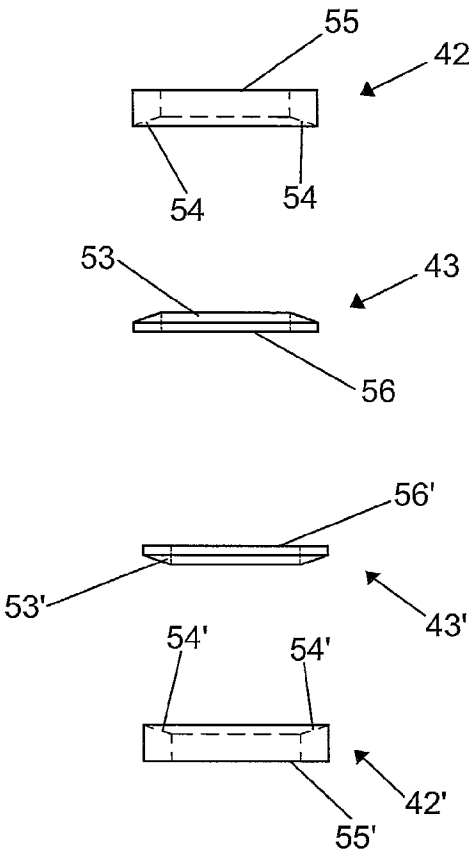
Figure 9:
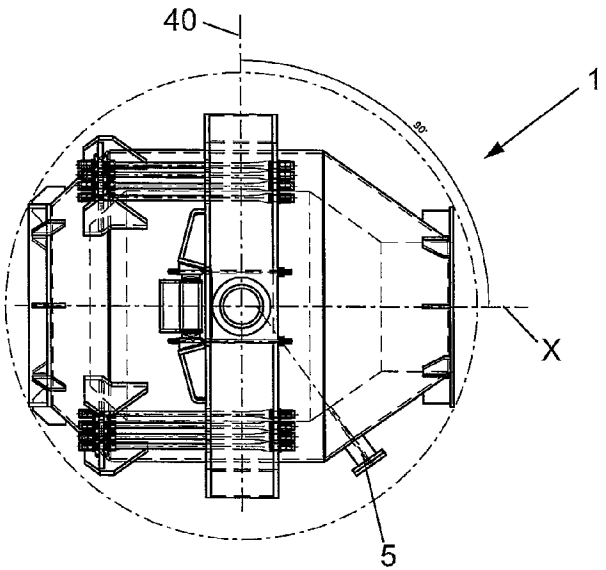
FIG. 9 shows the converter in FIG. 1 in a second operative steel tapping position.

In particular, with reference to FIGS. 4*a* and 5, the clamping locking system of the elastic bar 7' includes at each of the treaded ends 47 and 48 of the bar (FIG. 4*a*):

- outer tightening nuts 41, e.g. in a minimum number of two, to be tightened to the threaded end 14 of the bar 7';
- a first outer pair of spacers or washers 42, 43, to be arranged between said two tightening nuts 41 and the outer surface 10 of the end support 60; each spacer 42, 43 being provided with a respective hole 61, 62 for the passage of the threaded end of the bar 47, the spacer 43 having a surface of annular portion of spherical bowl 53 joined to a corresponding surface 54 provided in the spacer 42 (FIGS. 6 and 7);
- a second inner pair of spacers or washers 42', 43', to be arranged between the shoulder 52 of the bar 7' and the inner surface 10' of the end support 60; each spacer 42', 43' being provided with a respective hole 61', 62' for the passage of the threaded end of the bar 47, the spacer 43' having a surface of annular portion of spherical bowl 53' joined to a corresponding surface 54' provided in the spacer 42' (FIGS. 6 and 7).

A first end support 60 is provided with a hole 70 for the passage of a respective end of the bar (FIG. 4*a*).

With reference to FIGS. 4*a*, 5, 6 and 7, the spacer 42' rests with a flat surface 55' thereof on the shoulder 52, while the spacer 43' rests with a flat surface 56' thereof on the inner surface 10' of the end support 60. The spacer 43 rests instead with a flat surface thereof 56 on the outer surface 10 of the end support 60, while the flat surface 55 of the spacer 42 is pressed by the tightening nuts 41.

Tightening the nuts 41 on the threaded end 47 of the bar 7' the joined surfaces 53', 54' of the spacers 43', 42' and the joined surfaces 53, 54 of the spacers 43, 42 respectively achieve a complete contact with each other, while the flat surfaces 56, 56' adapt to the shape of the respective surfaces 10, 10' of the end support 60.

Advantageously, this clamping locking solution allows to compensate for misalignment errors of the surfaces 10, 10' by means of the sliding between the joined spherical-bowl shaped surfaces. The radius of the spherical-bowl shape is the same for both pairs of joined surfaces, but the centers are different, i.e. the two spherical-bowl shaped surfaces do not belong to the same spherical surface. As a consequence, this configuration of the spacers is a self-aligning "locked joint", i.e. a joint which cannot work as a ball joint but necessarily works as fixed joint when the bar is tightened.

The spherical-bowl shaped joined surfaces allow a rotation during the step of assembly so that these surfaces also join with each other. The flat surfaces 56, 56' of the spacers 43, 43' are deformed following the tightening, so that the contact between said flat surfaces 56, 56' and the resting surfaces 10, 10' is maximized in order to obtain a continuous rest.

The use of this locking system allows to avoid the use of high accuracy machines and thus higher manufacturing and managing costs. Furthermore, advantageously, this locking system allows to use a supporting ring without any openings in its outer side surface, needed to access the tightening area in the case of state-of-the-art spherically jointed tie-rods, thus determining a greater mechanical resistance of the ring structure.

Instead, with reference to FIGS. 4*a* and 5, the clamping locking system of the elastic bar 7' includes at the treaded end 48 of the bar (FIG. 4*b*):

- outer tightening nuts 41, e.g. in a minimum number of two, to be tightened onto the threaded end 48;
- two flanges 44, 45, or resting shims, to be arranged so that the end support 60' is arranged between said two flanges;
- a first outer pair of spacers or washers 42, 43, to be arranged between said tightening nuts 41 and the outer flange 45; each spacer 42, 43 being provided with a respective hole 61, 62 for the passage of the threaded end 48 of the bar 7', the spacer 43 having an annular portion surface 53 of spherical-bowl joined to a corresponding surface 54 provided in the spacer 42 (FIGS. 6 and 7);
- a second inner pair of spacers or washers 42', 43', to be arranged between the inner flange 44 and the inner nut 41'; each spacer 42, 43 being provided with a respective hole 61', 62' for the passage of the threaded end 48 of the bar 7', the spacer 43' having an annular portion surface 53' of spherical-bowl joined to a corresponding surface 54' provided in the spacer 42';
- an inner nut 41' to be tightened onto the intermediate threaded portion 49 to abut on the inner pair of spacers 42', 43'.

The first flange 45 is arranged between the outer pair of spacers 42, 43 and the respective outer surface 40 of the end support 60' and a second flange 44 is arranged between the inner pair of spacers 42', 43' and the respective inner surface 40' of the end support 60'. The diameter of the hole 80 of the end support 60' is larger than the diameter of the hole 70 of the end support 60. The flanges 44, 45 are provided with respective holes 90, 90' of diameter smaller than the diameter of hole 80. The flanges 44 and 45 may consist of semi-flanges kept integral to each other by means of fastening means, such as for example stud bolts with nut and lock nut; alternatively, the outer flange is made in a single piece instead.

With reference to FIGS. 4*b*, 6 and 7, the spacer 42' rests with a flat surface 55' thereof on the inner nut 41', while the spacer 43' rests with a flat surface 56' thereof on the flat surface of the inner flange 44. The spacer 43 rests instead with a flat surface thereof 56 on a flat surface of the outer flange 45, while the flat surface 55 of the spacer 42 is pressed by the outer tightening nuts 41.

Tightening the nuts 41 on the threaded end 48 of the bar 7' and tightening the inner nut 41' on the intermediate threaded portion 49, the joined surfaces 53', 54' of the spacers 43', 42' and the joined surfaces 53, 54 of the spacers 43, 42 respectively achieve a complete contact with each other, while the flat surfaces 56, 56' press on the flanges 44, 45 which will adapt to the shape of the respective surfaces 40, 40' of the end support 60'.

Advantageously, the inner tightening nut 41' is configured to be, in a fixed-end tie rod configuration, longer than length L of the useful part 200 of the thread of the intermediate threaded portion 49 protruding from the spacer 42' towards the inside of the bar 7'. This allows to avoid notching stress concentrations due to uncovered threads of the part subjected to bending of the bar itself. Once tightened, the inner nut 41' will thus have uncovered threads at the area in which the bar 7' tapers off towards the inside thereof.

In addition to the advantages deriving from the use of the pair of spacers with spherical joined surfaces discussed above, the fact of using the inner nut 41', completely accessible because provided on the outside of the supporting ring 3, allows to compensate for distance errors between resting surfaces, both those integral with the container and those integral with the supporting ring. The inner nut 41' is therefore an adjustment nut to compensate for these distance errors and to adapt the structure to the variable distances which may occur in design.

Advantageously, the presence of the flanges 44 and 45, defining further spacers, allows to maintain the hole 80 much larger than the diameter or thickness of the bar, thus assisting the passage of the bar and the assembly thereof onto the end supports. In this manner, in addition to compensating for distance planarity errors, the alignment errors between the hole 70 of end support 60 and the hole 80 of end support 60' are also compensated.

As a whole the above-described locking system of the bar to the end supports described above allows a considerable ease of assembly and centering simplicity.

The invention claimed is:

1. A suspension device for a tilting converter, comprising:

- a central structure, adapted to be fixed to a container of the tilting converter,
- a first lateral structure, arranged at a first side of said central structure and adapted to be fixed to a first surface of a supporting ring of the container,
- a second lateral structure, arranged at a second side of said central structure, opposite said first side, and adapted to be fixed to said first surface of the supporting ring,
- wherein two wedge-shaped elements are provided, each wedge-shaped element being arranged between the central structure and a respective lateral structure and configured so as to slide on two sliding surfaces of the central structure and of the respective lateral structure, respectively,
- wherein at least one tie-rod passes through a respective wedge-shaped element and has a first end thereof restrained to said respective wedge-shaped element,
- wherein elastic means associated to said at least one tie-rod or wherein said at least one tie-rod with its intrinsic elasticity are configured to produce a constant wedging of the wedge-shaped element between the central structure and the respective lateral structure whereby, when the suspension device is mounted to the container and to the supporting ring, the wedge-shaped element advances forwards or backwards with respect to the supporting ring as expansions produced between central structure and lateral structures vary during the operation of the converter,
- and wherein between the central structure and each wedge-shaped element there is provided a pair of spacers, having reciprocally adjacent, joined, substantially spherical-bowl-shaped surfaces, wherein an inner spacer of said pair of spacers is integrally fixed to the central structure while an outer spacer of said pair of spacers is interposed between the inner spacer and the wedge-shaped element and defines, with an outermost flat surface thereof, a first sliding surface for the wedge-shaped element.

2. A suspension device according to claim 1, wherein the elastic means, associated to said at least one tie-rod, are placed at one end of the tie-rod.

3. A suspension device according to claim 2, wherein a first end of the tie-rod is connected to the wedge-shaped element and the tie-rod has a predetermined longitudinal extension whereby it can pass through the supporting ring and has a second end, provided with a housing containing said elastic means, adapted to be arranged outside the supporting ring in proximity of a second surface thereof, opposite said first surface.

4. A suspension device according to claim 3, wherein a closing plate of the housing is provided, arranged between the elastic means and the tightening nuts of the second end of the tie-rod, whereby the elastic means acting on said closing plate allow a translation of the tie-rod and therefore a sliding of the wedge-shaped element.

5. A suspension device according to claim 2, wherein the tie-rod is integrally fixed at a first end thereof to the corresponding lateral structure and said elastic means are restrained to a second end of the tie-rod and placed in a housing made on the wedge-shaped element, whereby the elastic means can act directly on the wedge-shaped element, thus causing it to slide.

6. A suspension device according to claim 5, wherein a closing plate of the housing is provided, arranged between the elastic means and the tightening nuts of the second end of the tie-rod.

7. A suspension device according to claim 3, wherein said second end of the tie-rod passes through both the housing and the elastic means contained therein.

8. A suspension device according to claim 5, wherein said second end of the tie-rod passes through both the housing and the elastic means contained therein.

9. A suspension device according to claim 1, wherein a further spacer is provided between the lateral structures and each wedge-shaped element, said further spacer being integrally fixed to the respective lateral structure and defines, with an innermost surface thereof, a second sliding surface for the wedge-shaped element.

10. A suspension device according to claim 9, wherein the tie-rods have a first end thereof fixed within the further spacers, and pass through only one portion of the wedge-shaped element with a second end thereof.

* * * * *